United States Patent [19]

Steele

[11] 3,986,461

[45] Oct. 19, 1976

[54] CARREL

[76] Inventor: James C. Steele, 32 Maldiner St., Tonawanda, N.Y. 14150

[22] Filed: Aug. 25, 1975

[21] Appl. No.: 607,672

[52] U.S. Cl. ..... 108/60; 35/60
[51] Int. Cl.[2] ..... A47B 57/00
[58] Field of Search ..... 35/60; 108/60

[56] References Cited

UNITED STATES PATENTS

| | | | |
|---|---|---|---|
| 3,629,960 | 12/1971 | Roush | 35/60 |
| 3,636,890 | 1/1972 | Huff | 108/60 |
| 3,812,977 | 5/1974 | Glassman | 108/60 X |

*Primary Examiner*—James C. Mitchell

[57] ABSTRACT

An improved carrel for subdividing the area of a table surface comprises at least one support assembly consisting of a plurality of separate support elements secured together by elastic clamping means and supporting vertical partitions between the surfaces of the support elements. The carrel is easily assembled and disassembled and can be used without marring or permanently altering the table.

10 Claims, 8 Drawing Figures

FIG. 1
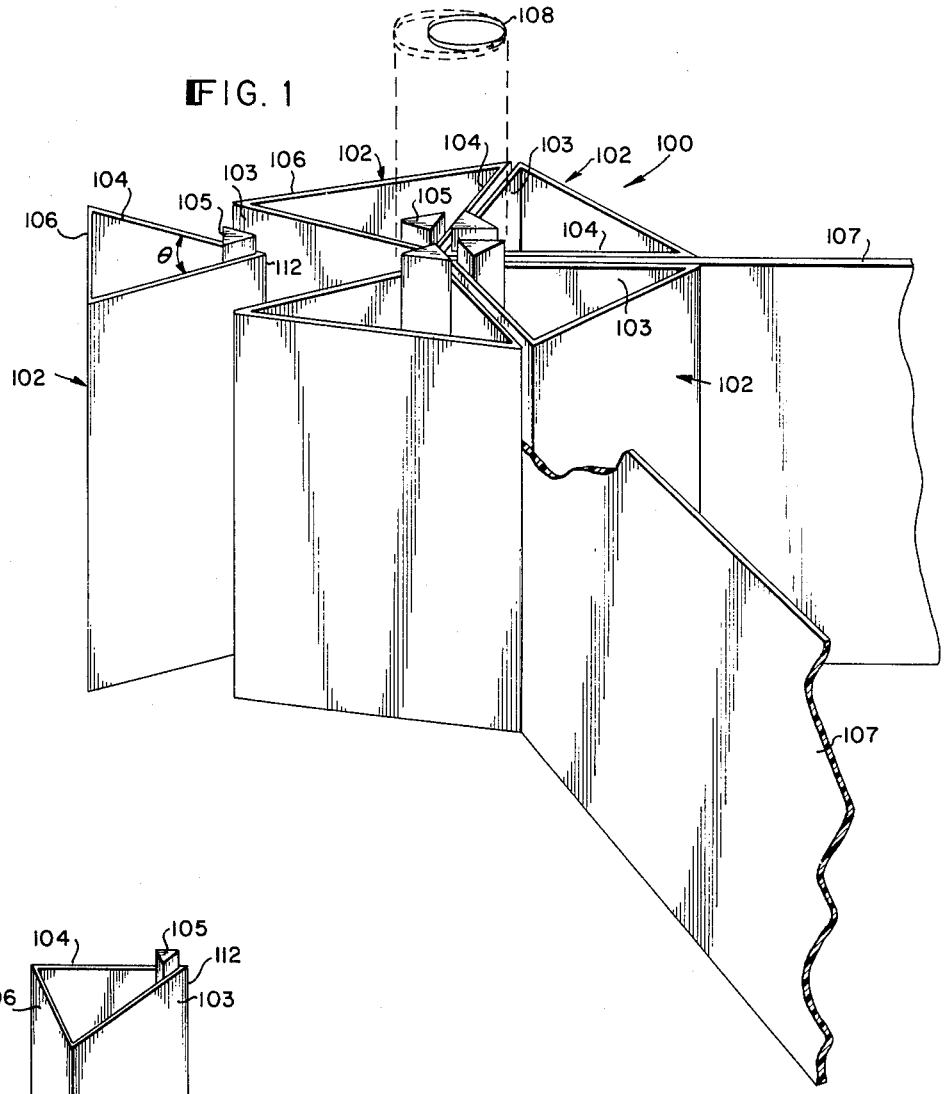
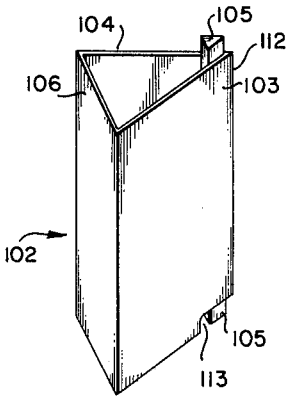
FIG. 1a
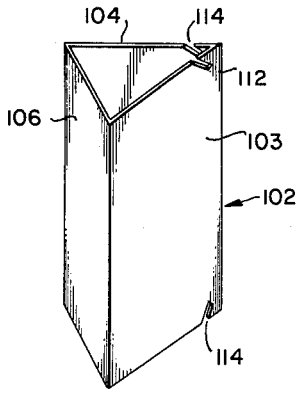
FIG. 1b

CARREL

BACKGROUND OF THE INVENTION

This invention concerns a device for subdividing a utility area such as a table top surface into subordinate areas. More particularly the invention comprises an improvement in devices known as carrels.

Carrels have long been employed to subdivide table surfaces into smaller subordinate areas. They are often used in schools to isolate work areas when several students utilize a single table, thereby providing a degree of seclusion or privacy to each student. They are also employed to compartmentize a display surface used for merchandising diverse products in a convenient and compact manner.

Heretofore, carrels have been expensive and complex, and have been bulky and heavy to handle and to set-up. They are often permanently installed on the table surface and, therefore, preclude subsequent use of the table for other than compartmentized work. Moreover, the installation of the carrel mars the table surface so that the table cannot be reassigned to non-compartmentized service without shop-work. Previously, carrels have also been inflexible devices which could not be modified or altered to reduce or increase the number or size of subordinate areas. In cases where carrels have been designed to be removable or demountable, they have been bulky and inconvenient to store.

It is an object of this invention to provide a carrel which is low in cost, light in weight and convenient to handle and assemble.

It is also an object to provide a carrel which does not require alternation or permanent modification of the table surface.

It is a further object to provide a carrel which is flexible in construction, allowing the addition or removal of compartments.

It is yet another object to provide a carrel which is demountable and easily disassembled for compact storage.

SUMMARY OF THE INVENTION

In accordance with this invention, an improved carrel comprises at least one vertically standing support assembly, and each assembly comprises at least two vertically standing support elements cmposed of stiff sheet material. Each support element contains two flat vertical sections joined together along at least one vertical edge of each section, and the sections of an element are angularly disposed with respect to each other such that the planes of their respective surfaces intersect to form an included angle. The support elements of each assembly are positioned together with the vertexes of their included angles approximately coincident and with each of their angularly disposed flat vertical sections parallel and adjacent to a flat vertical section of another support element if the assembly thereby providing at least two pairs of parallel and adjacent flat vertical sections in each support assembly. At least two flat vertically standing partitions are provided and an end of each is inserted between a different pair of parallel and adjacent flat vertical sections and the partition extends horizontally from the support assembly. The support elements of each assembly are secured together by elastic means so that the end of each partition is compressed between a pair of flat vertical sections.

In a preferred embodiment, the two flat vertical sections of each support element are joined along a vertical edge of each section proximate the vertex of the included angle and the other vertical edge of each section is free.

Also in a preferred embodiment the elastic means comprises a band of polymeric material stretched vertically around each pair of parallel and adjacent flat vertical sections.

BRIEF DESCRIPTION OF THE DRAWINGS

In the drawings:

FIG. 1 is an isometric view of an embodiment of the invention employing a single, central support assembly composed of three-sided, tubular support elements.

FIG. 1*a* is an isometric view of a support element of FIG. 1 showing provision at the lower end thereof for attaching elastic clamping means.

FIG. 1*b* is an isometric view of a support element similar to those of FIG. 1 showing alternative provision for attaching elastic clamping means.

DESCRIPTION

Figure 2:
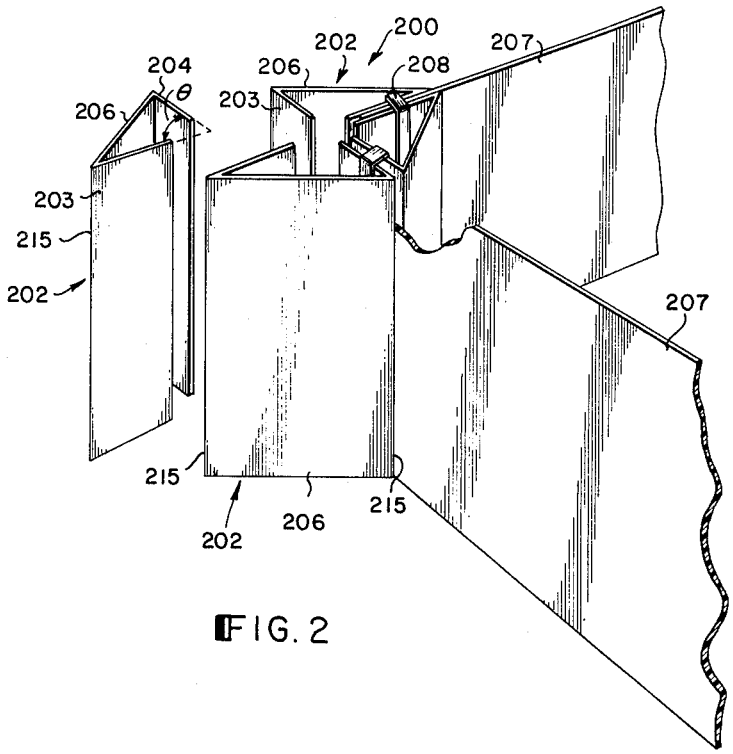
FIG. 2 is an isometric view of another embodiment of the invention employing a central, single support assembly composed of three-sided support elements which are open along one edge.

With reference to the drawings, FIG. 1 illustrates an embodiment of the invention utilizing a centrally-supported carrel. A single support assembly 100 consists of five triangular tube elements 102 each with two flat vertical sections 103 and 104. Sections 103 and 104 are joined along an apex 112 of the triangular tube and the planes of their surfaces intersect to form an included angle O. All elements 102 are clustered together with the vertexes of their included angles approximately coincident at the center of the support assembly. As illustrated in FIG. 1 the five elements 102 have equal included angles and the sum of all included angles is 360° so that each angle O is 360/5 or 72°.

Each tubular element 102 is provided with a post 105 which extends the length of the elemment with a small over-extension beyond the top of the tube for example about ½ inch. The post is preferably triangular in cross-section with an angle equal to the included angle O of the tubular element. This permits the post to fit snugly inside the included angle of the tube without shifting. The post may be a triangular tube or it may be solid, and it is composed of a material such as wood, plastic or molded or laminated composition. Its dimensions and composition are such as to render it stiff and mechanically stable.

An elastic clamping means such as a continuous rubber band 108 or do-nut shaped coil spring (not shown) is stretched around the ends of the posts which extend beyond the tubular elements. A single loop encompassing all posts is adequate, alternatively one or more elastic bands may be laced across the cluster of post-ends thereby binding each post-end to one or more post-ends opposite thereto in the assembly.

A preferred elastic means for interlacing the post-ends is a stretchable band of polymeric material. For example, a suitable means is a natural or synthetic rubber band ⅝-inch wide and 1/16-inch thick having sufficient elasticity to stretch about 0.2-inch per inch of relaxed length of single-thickness band material under a tensile load of one-pound. Alternatively, the band may be ¼-inch wide and 1/32-inch thick with sufficient elasticity to stretch 2 inches per inch of relaxed length of single-thickness band material under a tensile load of 1 pound. Bands of such dimension and strength can be obtained in various lengths, and may be stretched to varying extent for binding the post-ends.

At the bottom of the support assembly, the ends of all parts of the assembly rest against a smooth surface of a table or counter top and usually it is not convenient to extend the posts beyond the bottom ends of the tubular elements. Provision for elastically clamping the lower post-ends is shown in FIG. 1a wherein a notch 113 is cut in each of the vertical sections 103 and 104 at their bottom juncture. The notch dimensions are sufficient to expose the lower end of the post 105, and to additionally provide space behind each post-end for affixing an elastic clamping means. The elastic clamping means may be similar to that employed at the upper ends.

Instead of the over-extension of posts 105, a notched arrangement such as shown in FIG. 1a may also be employed at the upper end of the assembly. This has the advantage that a cover can be laid flat over the top of the center support structure to hide the internal parts and provide a more pleasing appearance. The cover also provides a platform which can be used to support various audio visual material that might be used.

Each flat vertical section 103 makes contiguous contact with a section 104 of an adjacent tubular element and forms therewith a pair of members which areelastically urged together. The outer vertical edges of sections 103 and 104 of each tubular element are joined by vertical section 106, and therefore, each tubular element acts as a wedge. The posts serve as beams and the centrally-directed force exerted on the posts by the elastic clamping means is transmitted to the tubular elements and is distributed along the center apex. The resultant wedging action presses each pair of sections 103 and 104 together across their contacting surfaces.

A partition board 107 is inserted between each of at least two pair of adjacent sections 103 and 104 and is clamped securely by the compression exerted thereon by the pair of sections 103, 104. Partition 107 is preferably inserted to near the center of the support structure and extends outward any desired distance, for example, to a point near the edge of a table. The space between two such partitions constitutes a compartment or isolated work area of a counter top or table.

If the material of the support elements is sufficiently stiff and resistant to tearing, the posts may be omitted. The elastic means may be secured to the elements by insertion into cuts or notches 114 provided in sections 103 and 104 as shown in FIG. 1b.

When in use, the assembled carrel of FIG. 1 is usually positioned with the support assembly in the center of a table and with the partitions extending outward to the edge of the table. The partitions are clamped securely between the support elements and remain vertical and radially positioned one to the other. However, the attachment of the partitions to the central support is not so rigid and firm that the support structure is susceptible to damage in the event the partitions are bumped or twisted, or if the center support is otherwise stressed by applying force to the free ends of the partitions.

A suitable material for elements 102 is a low density polyethylene, 0.090 inch thick having a tensile strength of 1000 to 2000 psi. Alternatively, a pressed fiberboard 1/16 inch thick and weighing 27 pounds per 100 square feet is suitable. The elements may, for example, be formed with an equilateral triangular cross-section 3-inches wide on each side and 12-inches high.

A suitable material for partitions 107 is a corrugated box board, preferably at least 40 pounds per 100 square feet. A particularly preferred partition material is a 24-inch wide corrugated box board 25 pounds per 100 square feet, finished chalkwhite one side, and creased and folded along the top edge to provide double-thickness material 12-inches wide with a finished surface on both exposed sides. The folded board is preferably glued together at its inner, contacting surfaces.

In the FIG. 1 embodiment the included angles of the tubular elements are fixed and this predetermines the maximum number and minimum size of compartments or isolated work areas to be produced by the carrel. Only limited flexibility is afforded in subdividing the table area. By omitting one or more partitions around the center support, the subdivisions may be increased in size and reduced in number.

FIG. 2 illustrates another embodiment of the invention which affords greater flexibility in assembly than the FIG. 1 arrangement. In FIG. 2 a center support assembly 200 is composed of four, generally triangular elements 202, each with two flat vertical sections 203 and 204. Sections 203 and 204 are joined to each other by common juncture with vertical section 206 at their outer edges, but, unlike the FIG. 1 elements, they are not joined to each other at their inner converging edges. Although the inner vertical edges of sections 203 and 204 are not joined the sections nevertheless define as included angle O at the intersection of the planes of their respective flat surfaces. All elements 202 are clustered together with the vertexes of their included angles O approximately coincident and the sum of all included angles is 360°. As shown, the respective members of all elements are equal in dimension so that all included angles are approximately equal, and each angle O is therefore 360/4 or 90°.

When assembled, each section 203 is adjacent a section 204 of another element and the two adjacent sections form a pair of sections. Each pair of adjacent sections 203 and 204 is clamped together by a suitable elastic device such as elastic band 208 (two such bands only being shown for simplicity). Band 208, which may be composed of rubber or other elastic polymeric material is stretched and wrapped around the pair of sections so that it compresses the surfaces of the pair of sections contiguously together. A suitable elastic means is a rubber band ⅝-inch wide and 1/16-inch thick with a length dependent to some degree on the height of the support assembly. If the assembly is 12-inches high, then a band of the above dimensions about 7-inches long (relaxed, end-to-end length of loop) is satisfactory. If the band is ¼-inch wide and 1/32 -inch thick then the length may be reduced to 3 ½-inches. In general, stronger bands should be longer in relaxed length since less stretching will be required to develop the desired clamping force on the assembly. Instead of rubber bands, metal or plastic clips may be applied over the adjacent edges of the two paired sections.

Partition boards 207 are inserted between at least two pairs of sections 203, 204 and are held tightly there-between by the compression exerted by the elastic clamping means. With four elements in the assembly, a total of four partitions can be inserted and will form four compartments radiating from the central support.

Preferably the edge junctures 215 between sections 203, 204 and between section 204 and 206 are flexible so the attachment acts somewhat as a hinge. This will permit the vertical sections 203 and 204 of an element to be either spread apart at their free inner edges or moved closer together, thereby altering the included angle O between their planes. In this way, the number of elements in an assembly can be reduced or increased so as to vary the number and size of compartments.

A convenient and economic way to fabricate the elements of FIG. 2 is by forming a single sheet of suitable material so that sections 203, 204 and 206 are integral. Suitable formable materials are plastics and fiberboards described for the FIG. 1 embodiment. When pressed fiberboard is used, it is preferred that it be plasticized to obtain both toughness and flexibility along the bend-line. The bend-lines at the junctures of sections 203 and 204 with section 206 may be indented or embossed so as to deflect preferentially along the bend-line when the included angle is changed. When elements are produced by heat-forming a plastic sheet, the normal thinning of the material at the crease will allow preferential flexing of the element at the bend-line.

An added advantage of using rubber or elastic bands wrapped vertically around adjacent flat vertical sections is that the contact of the bands with the table top helps to secure the entire carrel in its desired location on the table surface. A relatively high coefficient of friction exists between the rubber of the band and the table surface and resists movement of the carrel.

Figure 3:
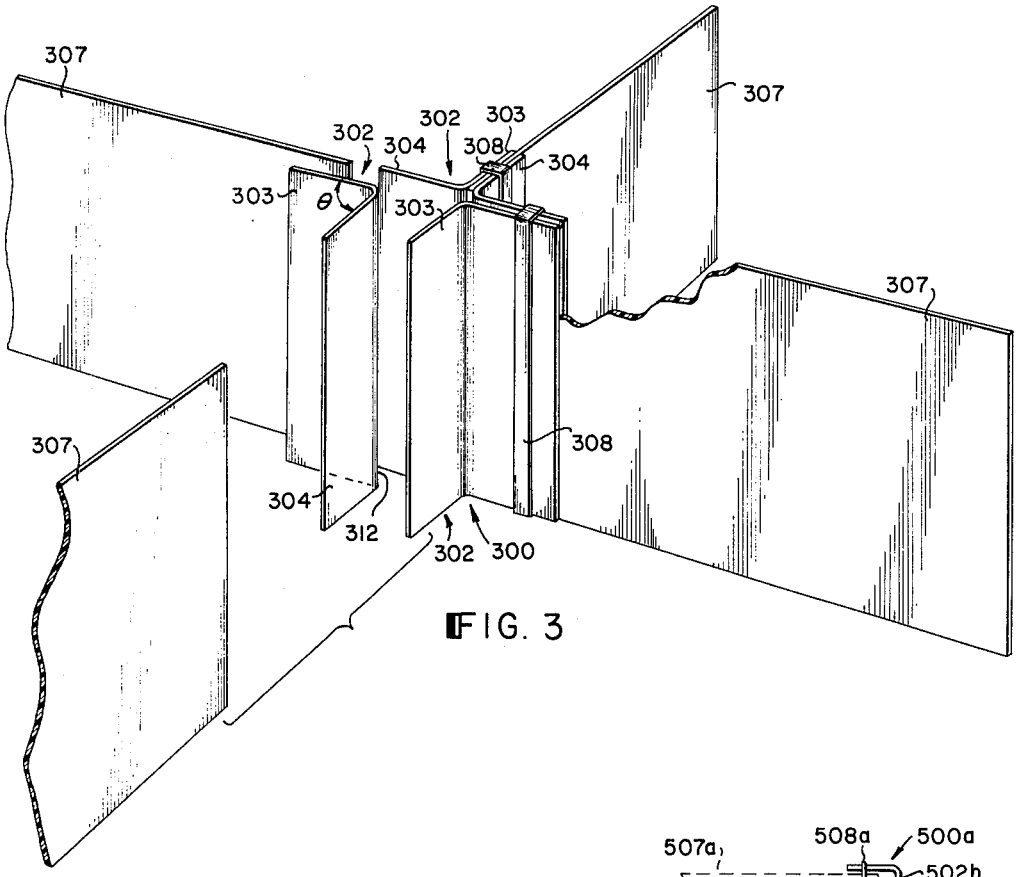
FIG. 3 is an isometric view of a preferred embodiment of the invention employing a central, single support assembly composed of two-sided angular support elements.

A preferred embodiment of the invention is illustrated in FIG. 3. Central support assembly 300 is composed of four angular elements 302 each of which contains flat vertical sections 303 and 304. The sections 303 and 304 of an element are joined at their inner converging edges at juncture 312 forming included angle O at the vertex, and their outer edges are unattached or "free." Preferably the elements are formed integrally as described in FIG. 2 and the bend-line at the vertex is indented, embossed or thinned so as to deflect preferentially at the bend-line. All elements are clustered with included angles approximately coincident and the sum of all angles is 360°.

When assembled, section 303 is adjacent section 304 of another element forming therewith a pair of sections which are elastically clamped together as by means of elastic band 308 stretched vertically around the pair of sections. A partition board 307 is inserted between at least two different pair of sections to form compartments therebetween.

By deflecting the sections of an element along the bend-line, the included angle can be changed to permit a lesser or greater number of elements to be clustered in the assembly. If the material of the elements is elastic or possesses a "memory" then the support assembly will tend to expand when the included angles of the elements are reduced to add more elements. Such expansion can be reduced or controlled by stretching other elastic bands vertically around the bend-lines of two opposite elements of the assembly. Thus in FIG. 3, a band may extend around the vertexes of the front and rear elements, and another band around left and right elements.

Figure 6:
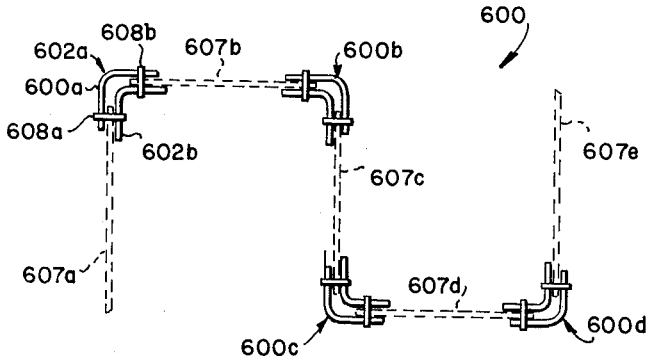
FIG. 6 is a plan view of another two-compartment carrel employing the invention and utilizing four support assemblies containing angular support elements as shown in FIG. 3.
Figure 4:
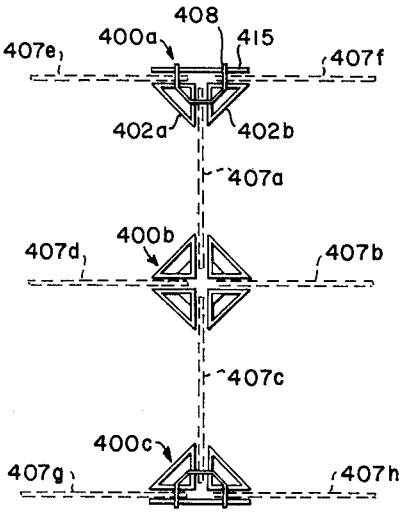
FIG. 4 is a plan view of a four-compartment carrel employing the invention and utilizing three support assemblies containing tubular support elements as shown in FIG. 1.
Figure 5:
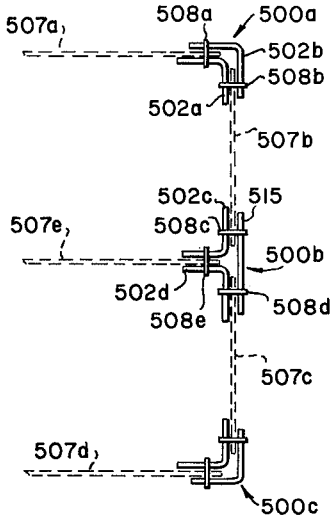
FIG. 5 is a plan view of a two-compartment carrel employing the invention and utilizing three support assemblies containing angular support elements as shown in FIG. 3.

All FIGS. 1 – 3 employ a central support assembly from which partition boards radiate outward to form sector-shaped compartments. As shown in FIGS. 4, 5 and 6, the invention has broader scope and utility than a central support arrangement with sector-shaped compartments. When rectangular or square compartments are desired, the arrangements of FIGS. 4, 5, and 6 can be assembled using elements and partition boards described in previous embodiments. The embodiments of FIGS. 4, 5, and 6 are in plan view showing the top edges of the elements and partitions. Solid lines represent support elements and broken lines represent the partition boards.

With reference to FIG. 4 the assembly comprises three support assemblies 400*a*, 400*b*, and 400*c*. Support assembly 400*b* consists of four tubular elements of the type illustrated in FIG. 1. The tubular elements may contain posts with elastic bands looped around or interlaced across the top ends and across the bottom ends to secure the elements of the assembly. Four partition boards 407*a*, 407*b*, 407*c*, and 407*d* extend outward from the assembly 400*b* from between pairs of vertical sections of the assembly. The opposite ends of partition boards 407*b* and 407*d* are "free" and may, for example, extend to the edge of a table on which the assembly rests. The opposite ends of partition boards 407*a* and 407*c* are clamped respectively between pairs of sections contained in support assemblies 400*a* and 400*c*.

Support assemblies 400*a* and 400*c* are similar T-shaped assemblies. Assembly 400*a*, typical of assemblies 400*a* and 400*c*, is composed of two tubular support elements 402*a* and 402*b* of the type described in FIG. 1 together with a flat support element 415. Support elements 402*a* and 402*b* each have an included angle of 90° and support element 415 has an included angle of 180°. All three support elements are clustered together with the vertexes of their included angles approximately coincident. It will be evident that a flat element has innumerable vertexes, any one of which can be made coincident with those of elements 402*a* and 402*b*. Preferably the vertex of flat element 415 is near the center of its width thereby providing two equal-width flat vertical sections, one on each side of the vertex.

Preferably the elastic clamping means for the FIG. 4 embodiment consists of elastic bands. For support assembly 400b an elastic band (not shown) may be looped or interlaced around the post-ends at both top and bottom as illustrated in FIG. 1. For the T-shaped support assembly 402*a* an elastic band 408*a* may be looped around the top ends of the posts of elements 402*a* and 402*b*, stretched down the outside surface of element 415 and looped around the bottom ends of the posts. Two partition boards 407*e* and 407*f* are inserted between pairs of adjacent sections, each such pair consisting of a vertical section of flat support element 415 and a vertical section of one of tubular element 402*a* and 402*b*.

The support elements of either FIG. 2 or FIG. 3 can easily be employed instead of the elements of FIG. 1 to produce the arrangement of FIG. 4. With the elements of either FIG. 2 or 3 elastic bands may be stretched vertically around each pair of adjacent sections.

In the embodiments illustrated in FIGS. 1–4 the elements composing a support assembly have been clustered together, which as herein defined means that the elements are assembled side-by-side around their coincident vertexes. Thus the sum of the included angles of all elements of an assembly is 360°. In the following embodiments it will be seen that elements of an assembly may, if desired, be nested rather than clustered. As used herein "nested" means that the elements of an assembly are assembled one inside the other so that their included angles are equal and are approximately coincident rather than being consecutively adjacent.

The arrangement of FIG. 5 is a two-compartment carrel using support elements similar to those of FIG. 3. Three support assemblies 500*a*, 500*b*, and 500*c* are employed. Each of support assemblies 500*a* and 500*c* consists of two angular elements 502*a* and 502*b* nested contiguously together with their included angles approximately coincident, thereby forming two pairs of flat vertical sections which are clamped together by elastic bands 508*a* and 508*b*. Partition boards 507*a* and 507*b* are clamped in support assembly 500*a*, and 507*a* extends to a "free" edge. Partition board 507*b* extends to and is clamped in support assembly 500*b*. The construction of assembly 500*c* is similar to 500*a*.

Assembly 500*b* is a T-shaped support and consists of two support elements 502*c* and 502*d* also of the angular type of FIG. 3, together with flat support element 515. Support elements 502*c* and 502*d* each have an included angle of 90° and support element 515 has an included angle of 180°. All three support elements are clustered together with the vertexes of their included angles approximately coincident. The pairs of support members of assembly 500*b* are clamped by elastic bands 508*c*, 508*d* and 508*e*. Three partition boards extend from support assembly 500*b*: 507*b* extending to assembly 500*a*, 507*c* extending to assembly 500*c*, and 500*e* extending to a "free" edge.

FIG. 6 is another two-compartment arrangement which employs four identical support assemblies 600*a*, 600*b*, 600*c*, and 600*d* of the type shown as items 500*a* and 500*c* in FIG. 5. Thus support assembly 600*a* consists of angular support elements 602*a* and 602*b* nested together and providing two pairs of flat vertical sections which secure first ends of partitions 607*a* and 607*b*. The second end of partition 607*a* is free while the second end of partition 607*b* *is secured between a pair of flat vertical sections of assembly 600b*. Similarly partition 607*c* has first and second ends secured respectively between pairs of flat vertical sections in support assemblies 600*b* and 600*c*, and partition 607*d* has ends secured in assemblies 600*c* and 600*d*. Partition 607*e* is secured in assembly 600*d* and extends to a free edge.

The two-element support assemblies such as 600*a* of FIG. 5 afford one of the simplest and most elementary embodiments of this invention. A carrel composed of a single support assembly of the two-element type, together with a partition extending from each of the two pairs of adjacent sections thereof, is a useful arrangement for isolating space on a table for a single student. Thus a complete carrel may consist only of a support assembly 500*a* of FIG. 5 together with partitions 507*a* and 507*b*.

A simple carrel may also be prepared using only one T-shaped support assembly together with three partition boards extending therefrom. An assembly such as 400*a* of FIG. 4 or 500*b* of FIG. 5 may be used. Thus a complete carrel may comprise only a support assembly 500*b* of FIG. 5 together with partitions 507*b*, 507*c* and 507*e*. Two isolated work areas may thus be provided but with somewhat less seculsion than when the full arrangement of FIG. 5 is employed.

What is claimed is:

1. An improved carrel comprising a. at least one vertically standing support assembly, each assembly comprising at least two vertically standing support elements formed of stiff sheet material.

b. each of said support elements containing two flat vertical sections joined together along at least one vertical edge of each section, said sections of an element being angularly disposed with respect to each other such that the planes of their respective surfaces intersect to form an included angle, c. the support elements of each assembly being positioned with the vertexes of their included angles approximately coincident and with each of their angularly disposed flat vertical sections parallel and adjacent to a flat vertical section of another support element of the assembly, thereby providing at least two pair of parallel and adjacent flat vertical sections in each support assembly, d. at least two flat vertically standing partitions each with a first end between a different pair of said parallel and adjacent flat vertical sections, and extending horizontally from the support assembly, and e. elastic means securing the support elements of an assembly together and compressing each partition between said pair of parallel and adjacent flat vertical sections.

2. A carrel according to claim 1 wherein the number of vertically standing support assemblies in said carrel is one, said support assembly contains at least three support elements clustered together with the vertexes of their included angles approximately coincident, and said partitions radiate outwardly from the coincident vertexes.

3. A carrel according to claim 2 wherein said two flat vertical sections of each support element are joined along a vertical edge of each section proximate the vertex of said included angle, and the other vertical edge of each section is free.

4. A carrel according to claim 1 wherein said carrel contains a plurality of support assemblies, and at least one partition extending from each support assembly has a second end secured between a pair of flat vertical sections of another support assembly.

5. A carrel according to claim 1 wherein said vertically standing support assembly of the carrel comprises three support elements, two of said elements each having an included angle of 90°, the third of said elements being flat with an included angle of 180°, said three support elements being clustered together with the vertexes of their included angles approximately coincident thereby providing three pairs of parallel and adjacent flat vertical sections, and three partitions extending from said support assembly, each partition having a first end between a respective pair of flat vertical sections.

6. A carrel according to claim 5 wherein at least one of said three partitions which extend from said vertically standing support assembly has a second end secured between a pair of parallel and adjacent flat vertical sections of another vertically standing support assembly of said carrel.

7. A carrel according to claim 1 wherein the number of support elements contained in said support assembly is two, said two flat vertical sections of each support element are joined along a vertical edge of each section proximate the vertex of the included angle, the other vertical edge of each section is free, and said two support elements are nested together with their included angles equal and their vertices approximately coincident thereby providing two pairs of parallel and adjacent flat vertical sections, and two partitions extending from said support assembly, each partition having a first end between a respective pair of flat vertical sections.

8. A carrel according to claim 7 wherein at least one of said two partitions which extend from said vertically standing support assembly has a second end secured between a pair of parallel and adjacent vertical sections of another vertically standing support assembly of said carrel.

9. A carrel according to claim 1 wherein said elastic means is a band of polymeric material stretched vertically around a pair of parallel and adjacent flat vertical sections.

10. An improved carrel comprising a. a single vertically standing support assembly comprising at least three vertically standing support elements formed of stiff sheet material, b. each of said support elements containing two flat vertical sections angularly disposed with respect to each other such that the planes of their respective surfaces intersect to form an included angle, said sections of an element being joined along a vertical edge of each section proximate the vertex of said included angle and the other vertical edge of each section being free, c. the support elements of said assembly being clustered with the vertexes of their included angles being approximately coincident and with each of their angularly disposed flat vertical sections being parallel and adjacent to a flat vertical section of another support element of the assembly, thereby providing at least three pairs of parallel and adjacent flat vertical sections.

d. at least three vertically standing partitions each with a first end in a different pair of said parallel and adjacent flat vertical sections and extending radially and horizontally from the coincident vertexes, and e. a band of elastic polymeric material stretched vertically around each pair of parallel and adjacent flat vertical sections thereby securing the support elements of the assembly together and compressing each partition between said pair of parallel and adjacent flat vertical sections.

* * * * *